US007648044B2

(12) United States Patent
Reinsel et al.

(10) Patent No.: US 7,648,044 B2
(45) Date of Patent: Jan. 19, 2010

(54) SHEET PRODUCT DISPENSER

(75) Inventors: Christopher M. Reinsel, Neenah, WI (US); Michael R. Kilgore, Little Suamico, WI (US); Rachel DeSmidt, Madison, WI (US); Frances Alexay, Atlanta, GA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 4 days.

(21) Appl. No.: 12/109,952

(22) Filed: Apr. 25, 2008

(65) Prior Publication Data

US 2008/0264965 A1 Oct. 30, 2008

Related U.S. Application Data

(60) Provisional application No. 60/914,356, filed on Apr. 27, 2007.

(51) Int. Cl.
*A47K 10/32* (2006.01)

(52) U.S. Cl. ..... 221/35; 221/34; 221/61; 221/62; 221/154; 221/281

(58) Field of Classification Search ..... 221/1–312 C
See application file for complete search history.

(56) References Cited

U.S. PATENT DOCUMENTS

| | | | | |
|---|---|---|---|---|
| 2,207,520 | A * | 7/1940 | Rhody | 206/229 |
| 2,426,136 | A | 8/1947 | Agamaite, Jr. | |
| 2,852,158 | A | 9/1958 | Jones et al. | |
| D285,173 | S * | 8/1986 | Davis | D9/734 |
| 4,679,703 | A | 7/1987 | De Luca | |
| 4,838,454 | A | 6/1989 | Salzmann et al. | |
| 5,076,466 | A | 12/1991 | Petterson et al. | |
| 5,102,007 | A * | 4/1992 | Petterson et al. | 221/6 |
| D334,690 | S | 4/1993 | Chudek et al. | |
| D337,270 | S | 7/1993 | Brockman | |
| D348,393 | S | 7/1994 | Neitzke et al. | |
| 5,564,240 | A | 10/1996 | Dean, Jr. | |
| D438,988 | S | 3/2001 | Dean, Jr. | |
| 6,196,161 | B1 * | 3/2001 | Thurber | 119/496 |

(Continued)

FOREIGN PATENT DOCUMENTS

JP 08-206034 A 8/1996

(Continued)

OTHER PUBLICATIONS

U.S. Appl. No. 29/279,348, filed Apr. 27, 2007, entitled "Sheet Product Dispenser".

(Continued)

*Primary Examiner*—Gene Crawford
*Assistant Examiner*—Michael K Collins
(74) *Attorney, Agent, or Firm*—Joel T. Charlton

(57) ABSTRACT

A sheet product dispenser includes a housing adapted to house sheet products therein, the housing having an arching wall, a first planar wall disposed in contact with the arching wall, and a second planar wall disposed in contact with the arching wall and the first planar wall; an opening disposed in the first planar wall or the second planar wall, the opening having a size sufficient to allow dispensing of the sheet products there-through; and an access panel forming a portion of the arching wall.

9 Claims, 4 Drawing Sheets

U.S. PATENT DOCUMENTS

| | | | | |
|---|---|---|---|---|
| D454,015 | S | 3/2002 | Okin et al. | |
| D461,024 | S * | 7/2002 | Newdoll | D30/108 |
| 6,457,605 | B2 | 10/2002 | Coleman | |
| 6,585,129 | B2 | 7/2003 | Moody et al. | |
| D483,158 | S * | 12/2003 | Ward | D30/161 |
| 6,799,695 | B1 * | 10/2004 | Borrero | 221/59 |
| D526,165 | S | 8/2006 | Burns et al. | |
| D533,971 | S * | 12/2006 | Carter et al. | D30/108 |
| 7,341,166 | B2 * | 3/2008 | Reinsel et al. | 221/59 |
| D578,021 | S * | 10/2008 | Reinsel et al. | D9/734 |
| 2003/0019880 | A1 | 1/2003 | Timmers et al. | |
| 2003/0062375 | A1 | 4/2003 | Christensen et al. | |
| 2006/0086748 | A1 * | 4/2006 | Burns et al. | 221/35 |
| 2007/0262086 | A1 * | 11/2007 | Cook et al. | 221/305 |

FOREIGN PATENT DOCUMENTS

| | | | |
|---|---|---|---|
| JP | 11-000282 | A | 1/1999 |
| JP | 2003-327251 | A | 11/2003 |
| KR | 20-0232502 | Y1 | 9/2001 |

OTHER PUBLICATIONS

International Search Report and Written Opinion of the International Searching Authority, issued Aug. 25, 2008, in connection with PCT/US2008/0061606.

English translation of abstract of JP 08/206034 A, publication date Aug. 13, 1996, Aihara.

English translation of abstract of JP 11-000282 A, publication date Jan. 16, 1999, Yoshizawa.

English translation of abstract of JP 2003-327251 A, publication date Nov. 19, 2003, TTM Co Ltd.

* cited by examiner

SHEET PRODUCT DISPENSER

CLAIM FOR PRIORITY

This non-provisional application is based upon U.S. Provisional Patent Application Ser. No. 60/914,356, of the same title, filed Apr. 27, 2007. The priority of U.S. Provisional Patent Application Ser. No. 60/914,356 is hereby claimed and the disclosure thereof is incorporated into this application by reference.

BACKGROUND

The present disclosure generally relates to sheet product dispensers, and more particularly, to sheet product dispensers allowing at least two different orientations of dispensing.

One example of a sheet product dispenser is an inter-folded napkin dispenser. Inter-folded napkin dispensers are well known in the art. For example, a gravity-feed dispenser and method of dispensing inter-folded napkins is described in United States Patent Application Publication No. 2003/0062375 to Christensen et al. Such dispensers are particularly useful where a large number of napkins need to be made available at a single location. Likewise, there is disclosed in U.S. Pat. No. 6,585,129 to Moody et al., a napkin dispenser for inter-folded napkins, which may be placed on tabletops giving consumers multiple access points in a given eating establishment.

Spring-loaded dispensers, which are often used in restaurants, are somewhat prone to being over-filled such that they do not operate properly and are relatively expensive. These dispensers also may cause unwanted curl to be imparted to the napkins. See United States Patent Application Publication No. 2003/0019880 to Timmers et al. Further features and general background may be found in the following patents: U.S. Pat. No. 5,076,466 to Petterson et al.; U.S. Pat. No. 4,838,454 to Salzmann et al.; U.S. Pat. No. 4,679,703 to De Luca; U.S. Pat. No. 2,852,158 to Jones et al., as well as U.S. Pat. No. 2,426,136 to Agamaite, Jr.

Despite advances in the art, a continual need exits for relatively inexpensive sheet product dispensers, especially dispensers that are designed to reliably supply inter-folded napkins in a commercial setting.

BRIEF SUMMARY

Disclosed herein are sheet product dispensers.

In one embodiment, a sheet product dispenser includes: a housing adapted to house sheet products therein, the housing having an arching wall, a first planar wall disposed in contact with the arching wall, and a second planar wall disposed in contact with the arching wall and the first planar wall; an opening disposed in the first planar wall or the second planar wall, the opening having a size sufficient to allow dispensing of the sheet products there-through; and an access panel forming a portion of the arching wall.

In one embodiment, a sheet product dispenser, includes: a housing adapted to house sheet products therein, the housing having a first arching wall, a second arching wall, a first planar wall and a second planar wall that are parallel to each other and are each in contact with the first and second arching walls, a third planar wall and a fourth planar wall that are each in contact with the first arching wall, the second arching wall, the first planar wall, and the fourth planar wall; a first opening disposed in the third planar wall, the first opening having a size sufficient to allow dispensing of the sheet products there-through; a second opening disposed in the fourth planar wall, the second opening having a size sufficient to allow dispensing of the sheet products there-through; and an access panel forming a portion of the first arching wall.

In one embodiment, a sheet product dispenser, includes: a housing adapted to house sheet products therein, the housing having a first arching wall, a second arching wall, a first planar wall and a second planar wall that are parallel to each other and are each in contact with the first and second arching walls, a third planar wall and a fourth planar wall that are each in contact with the first arching wall, the second arching wall, the first planar wall, and the fourth planar wall; a first opening disposed in the third planar wall, the first opening having a size sufficient to allow dispensing of the sheet products there-through; and a removable plug having a size corresponding to the first opening or the second opening that is removably disposed in the first opening or the second opening; and a spring disposed on an interior surface of the removable plug.

The above described and other features are exemplified by the following Figures and detailed description.

BRIEF DESCRIPTION OF THE DRAWINGS

Referring to the exemplary drawings wherein like elements are numbered alike in the several Figures.

DETAILED DESCRIPTION

Figure 1:
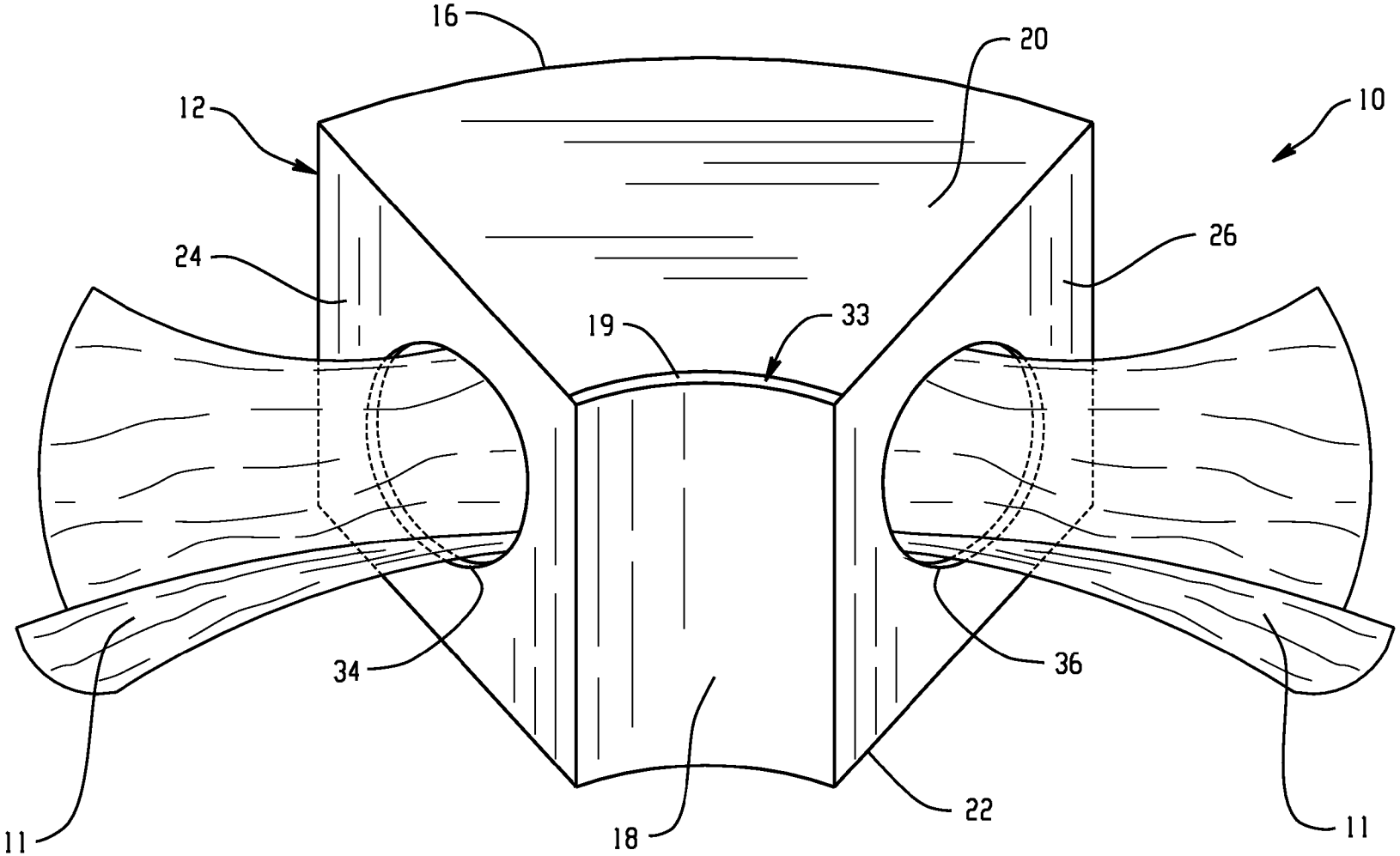
FIG. 1 is a perspective side view of an embodiment of a sheet product dispenser.
Figure 2:
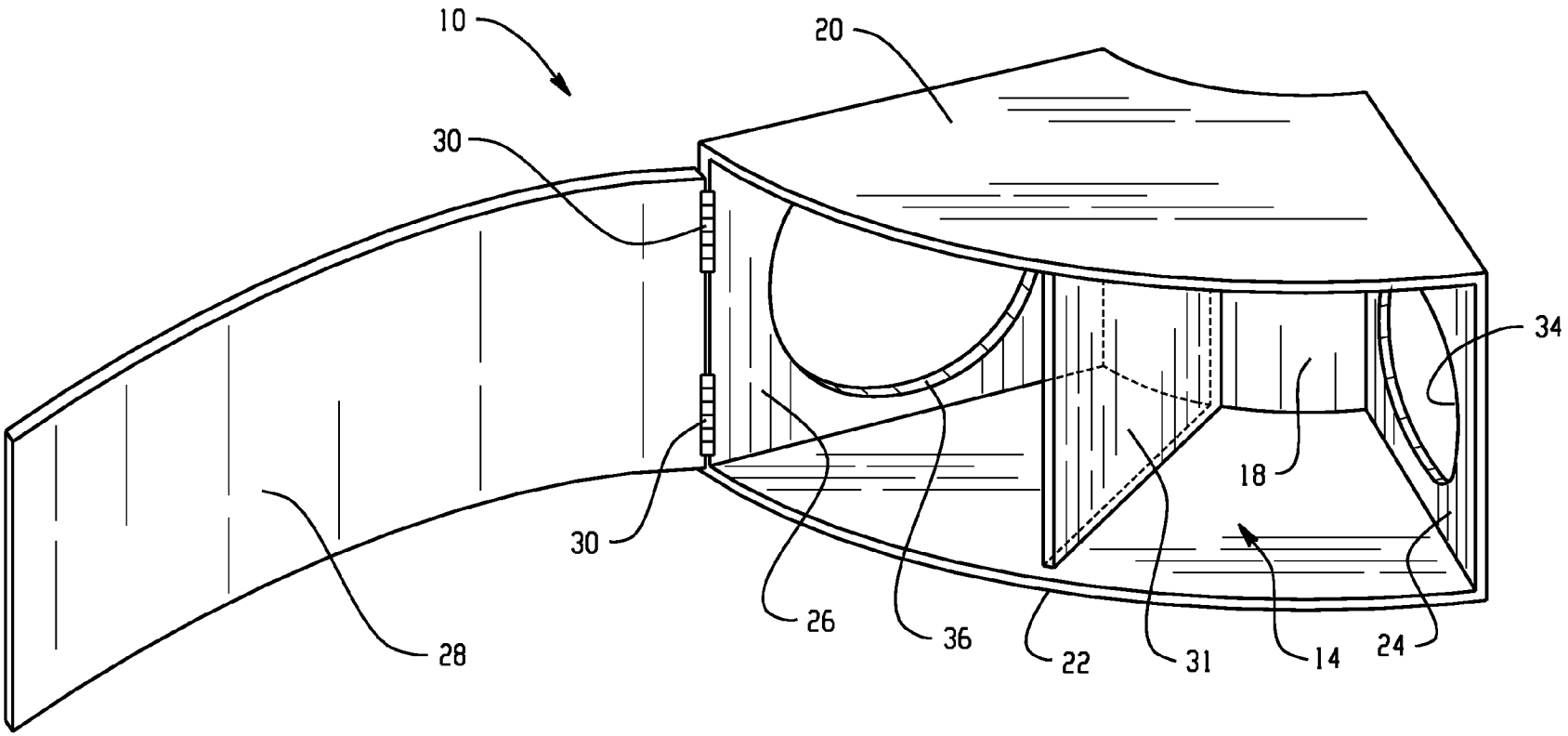
FIG. 2 is a perspective side view of an embodiment of a sheet product dispenser illustrating an access panel.

Disclosed herein are sheet product dispensers. The dispensers disclosed herein advantageously allow dispensing of sheet products in multiple orientations, which is an improvement over present day dispensers that typically allow dispensing from only one orientation. While reference is made through this specification to napkins, it is understood that the dispenser disclosed herein can be employed with a number of different sheet products. Any reference to napkins is made merely for ease in discussion and to provide an example of a suitable use for the dispenser.

The terms "first," "second," and the like herein do not denote any order or importance, but rather are used to distinguish one element from another, and the terms "a" and "an" herein do not denote a limitation of quantity, but rather denote the presence of at least one of the referenced items.

The term "sheet products" as used herein is inclusive of natural and/or synthetic cloth or paper sheets. Further, sheet products may include both woven and non-woven articles. Examples of sheet products include, but are not limited to, wipers, napkins, tissues, and towels.

Referring now to FIGS. 1-4, an embodiment of a sheet product dispenser generally designated 10 is illustrated. The sheet product dispenser includes a housing 12. The housing 12 includes a plurality of walls that define a storage cavity 14 for storing sheet products 11, wherein at least one wall has an arch-like shape (e.g., a segment of a circle). More particularly, in one embodiment, the housing 12 may include: a first arching wall 16; a second arching wall 18; a first planar wall 20 and a second planar wall 22 that are parallel to each other and are each in contact with the first arching wall 16 and second arching wall 18; and a third planar wall 24 and a fourth planar wall 26 that are each in contact with the first arching wall 16, the second arching wall 18, the first planar wall 20, and the second planar wall 22.

Suitable materials for the housing 12 include, but are not limited to, wood, metal, glass, plastic, and a combination including at least one of the foregoing. In one embodiment, the dispenser 10 comprises a plastic material. Plastic advantageously allows ease in manufacturing, as well as low cost in manufacturing. In one embodiment, the housing 12 is made from a substantially amorphous molding resin such as acrylonitrile-butadiene-styrene (ABS) resin, polycarbonate, or the like.

An access panel 28 includes at least a portion of the first arching wall 16. The access panel 28 allows the dispenser 10 to be refilled as necessary with sheet products 11. The access panel 28 may be connected to any one of the non-arching walls (e.g., planar walls 20, 22, 24, 26). In one embodiment, the access panel 28 is pivotally connected to at least one of the non-arching walls via a hinge 30. In other embodiments, the access panel 28 may be snap-fit in place or otherwise disposed in place to form at least a portion of the first arching wall 16.

Figure 3:
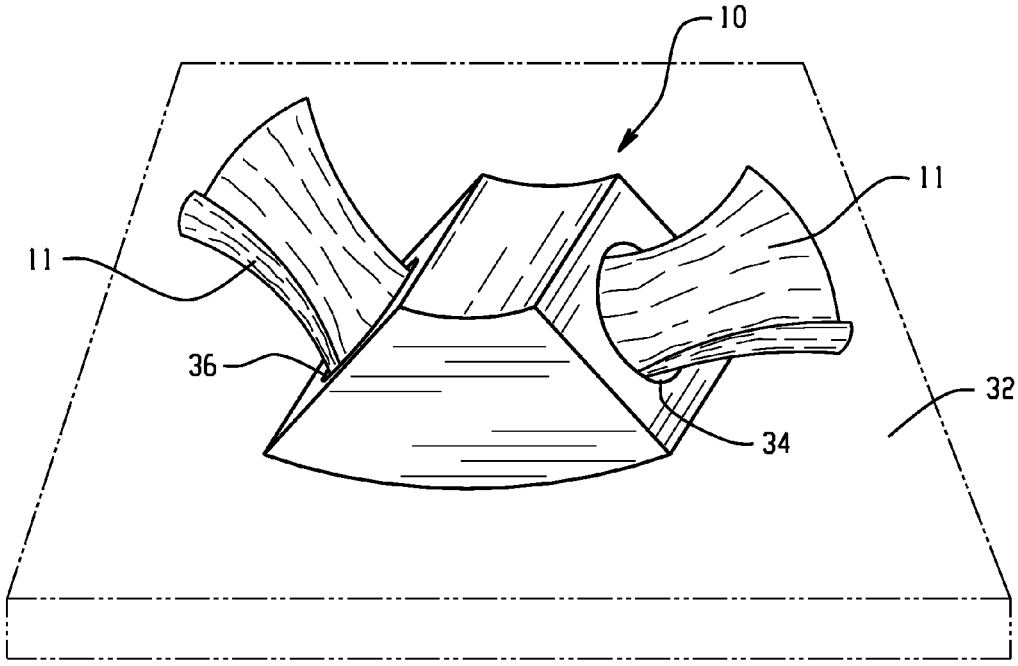
FIG. 3 is a side perspective side view of an embodiment of a sheet dispenser illustrating one orientation for dispensing.

The first arching wall 16 offers a number of advantages over present day dispensers that typically have all planar walls. In one embodiment, the dispenser 10 may be oriented on a surface 32 (e.g., a table top or counter top) as illustrated in FIG. 3. The first arching wall 16 allows the dispenser 10 to rock on the surface 32, which advantageously provides a level of interaction to the user. Since many sheet product dispensers are used in food service establishments, this level of interaction may add to the favorable dinning experience, especially for patrons with children. This rocking feature may be an amusing feature that would encourage children to use the sheet products 11 contained within the dispenser 10.

Without wanting to be bound by theory, the arching wall(s) (16, 18) may also allow better dispensing compared to dispensers having only planar walls. It is believed that at least one arching wall (16) allows the sheet products 11 to fall toward an opening of the dispenser 10 in some dispensing orientations (e.g., a horizontal dispensing orientation illustrated in FIG. 1). One of skill in the art will readily understand that the size of the dispenser is a function of the arc-angle. In various embodiments, the arching wall(s) can have a degree of curvature of about 30 degrees to about 60 degrees. In on embodiment, it is particularly desired to have a degree of curvature of about 40 degrees to about 50 degrees.

The dispenser 10 includes at least one opening 34 having a size sufficient to allow dispensing of the sheet products 11 there-through. In one embodiment, the opening 34 is disposed in the third planar wall 24. In another embodiment, the dispenser 10 includes the opening 34 disposed in the third planar wall 24 and a second opening 36 disposed in the fourth planar wall 26. Multiple openings allow for increased options in dispensing the sheet products 11. Suitable shapes for the opening(s) include, but are not limited to, circular, square, rectangular, polygonal, T-shaped, U-shaped, and elongated-slit shaped.

The dispenser 10 may optionally include an interior petition wall 31 to additionally aid in dispensing sheet products 11 by preventing the sheet products 11 from falling back toward a central potion of the dispenser 10. The dispenser 10 may also include a slot 33 adapted for disposing merchandising material. The slot 33 can be formed by tabs, a panel, and the like. As illustrated in FIG. 1, the slot 33 is formed between second arching wall 18 and an interior slot wall 19.

Figure 4:
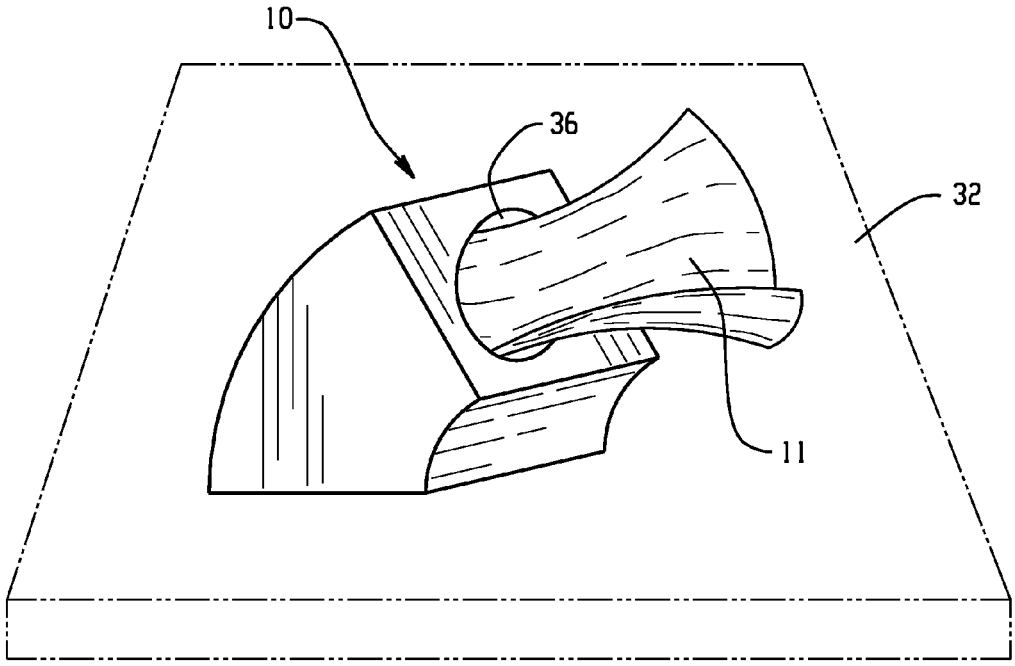
FIG. 4 is a side perspective side view of an embodiment of a sheet dispenser illustrating another orientation for dispensing.
Figure 5:
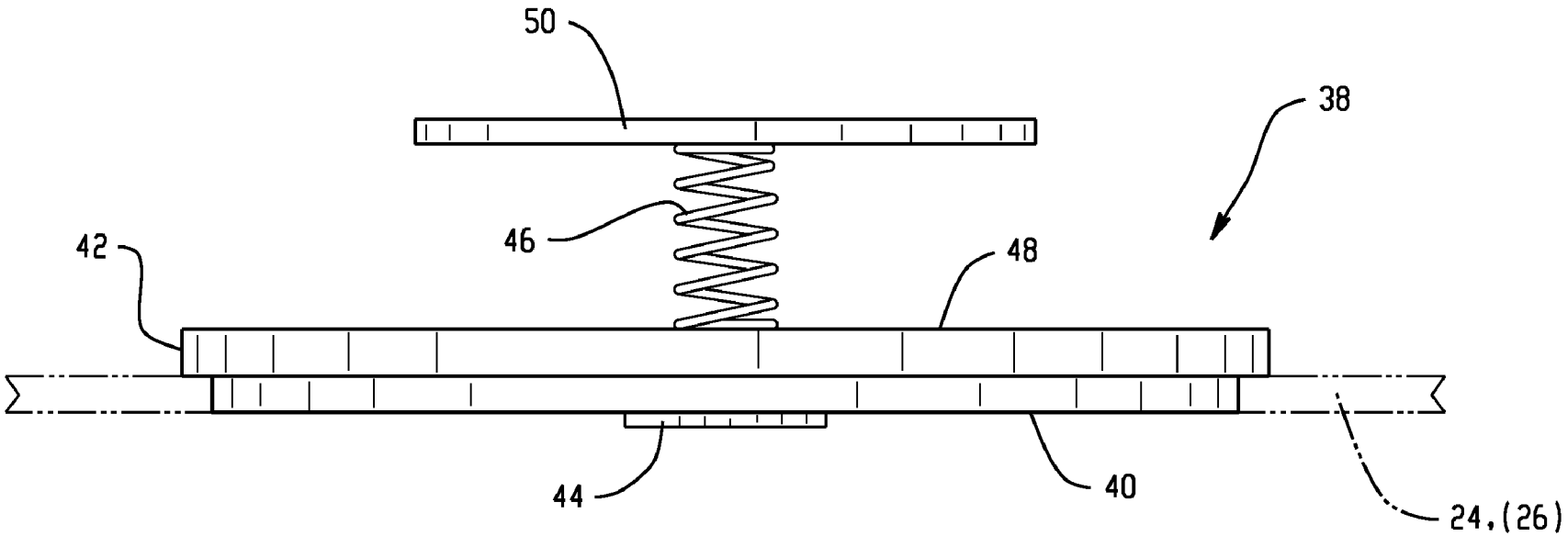
FIG. 5 is a schematic cross-sectional view of an embodiment of a plug for an opening of a sheet product dispenser.

Referring now to FIG. 5 with reference back to the dispenser 10 of FIGS. 1-4, an optional plug 38 is illustrated. In one embodiment, the plug 38 comprises at least one surface 40 having a corresponding shape and size to one of the openings (e.g., 34). The plug 38 can act to close off one of the openings to limit the number of dispensing openings. The plug 38 may also comprise a number of additional features that can be further beneficial to the user of the dispenser 10. For example, in one embodiment having a circular opening 34, the plug 38 can comprise a circular surface 40 and a collar 42. The collar 42 allows the circular surface 40 to rotate within the opening (e.g., 34), which may be a desired feature if the dispenser 10 is mounted. In other words, it is envisioned in some embodiments that the plug 38 may be used as a mounting feature to allow the dispenser 10 to be rotated when mounted.

The plug 38 may optionally also include a mounting means 44 coupled to the surface 40 to allow for ease in mounting. For example, suitable mounting means 44 include, but are not limited to, double-stick tapes, hook-and-loop fasteners, holes (for mating with corresponding features on a mounting surface), suction cups, and snaps. Additionally, the plug 38 may also include an optional spring 46 coupled to a second surface 48 that is disposed opposite the surface 40. When the plug 38 is inserted into the opening (e.g., 34), the surface 40 generally forms an exterior surface of the dispenser 10, while the surface 48 forms an interior surface to the dispenser 10.

The spring 46 may have a plate 50. The spring 46 and/or combination of spring 46 and plate 50 can be used to allow increased options for dispensing sheet products 11. For example, in one embodiment, the plug 38 with the spring 46 may be disposed in opening 34. The surface 40 blocks off the opening 34, while the spring 46 is disposed within the storage cavity 14. The spring 46 can provide increased resistance against the sheet products 11 to help minimize fall back into the dispenser 10. This configuration of dispensing may be particularly useful in the dispensing orientation illustrated in FIG. 4.

Without wanting to be bound by theory, the use of the spring 46 may be particularly useful in the dispensing orientation illustrated in FIG. 4. In this orientation, gravity is working to pull back on the dispenser 10, which can result in fall back of the sheet products 11 into the dispenser 10. The use of the spring 46 can advantageously help reduce fall back by pushing the sheet products 11 in a general direction toward an opening (e.g., 36, FIG. 4) of the dispenser 10.

It is to be understood that other embodiments are envisioned where the spring is coupled to a wall of the dispenser instead of a plug. In other words, rather than using a plug to fill an opening, the spring may be in physical communication with a wall of the dispenser that does not have an opening.

Embodiments disclosed herein may be particularly useful for dispensing inter-folded napkins in a commercial setting (e.g., a restaurant). The dispensers disclosed herein advantageously allow dispensing of sheet products in multiple orientations. Furthermore, the dispensers disclosed herein offer a low cost solution to the customer, while providing a dispenser that may be used to accommodate a variety of dispensing styles. For example, the dispenser may be dispensed from the top and any number of side(s).

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A sheet product dispenser, comprising:

a housing adapted to house sheet products therein, the housing having a first arching wall, a second arching wall, a first planar wall and a second planar wall that are parallel to each other and are each in contact with the first and second arching walls, a third planar and a fourth planar wall that are each in contact with the first arching wall, the second arching wall, the first planar wall, and the fourth planar wall;

a first opening disposed in the third planar wall, the first opening having a size sufficient to allow dispensing of the sheet products there-through;

a second opening disposed in the fourth planar wall, the second opening having a size sufficient to allow dispensing of the sheet products there-through; and an access panel forming a portion of the first arching wall.

2. The sheet product dispenser of claim 1, further comprising an interior partition wall disposed within the housing.

3. The sheet product dispenser of claim 1, further comprising a removable plug having a size corresponding to the first opening or the second opening that is removably disposed in the first opening or the second opening.

4. The sheet product dispenser of claim 3, further comprising a spring disposed on an interior surface of the removable plug.

5. The sheet product dispenser of claim 3, further comprising a fastening means disposed on an exterior surface of the removable plug.

6. The sheet product dispenser of claim 3, wherein the plug has a collar that allows the plug to rotate within the first opening or the second opening.

7. The sheet product dispenser of claim 1, wherein the first opening is a circle.

8. The sheet product dispenser of claim 1, wherein the access panel is pivotally connected to the second planar wall.

9. The sheet product dispenser of claim 1, wherein the sheet products are napkins.

* * * * *

UNITED STATES PATENT AND TRADEMARK OFFICE

CERTIFICATE OF CORRECTION

PATENT NO. : 7,648,044 B2
APPLICATION NO. : 12/109952
DATED : January 19, 2010
INVENTOR(S) : Christopher M. Reinsel et al.

It is certified that error appears in the above-identified patent and that said Letters Patent is hereby corrected as shown below:

Column 5, line 17, "fourth" should be changed to --second--.

Signed and Sealed this
Seventeenth Day of April, 2012

David J. Kappos

David J. Kappos
*Director of the United States Patent and Trademark Office*